United States Patent [19]

Amtmann

[11] 4,234,793

[45] Nov. 18, 1980

[54] X-RAY DIAGNOSTIC GENERATOR FOR OPERATION WITH FALLING LOAD

[75] Inventor: Heribert Amtmann, Buckenhof, Fed. Rep. of Germany

[73] Assignee: Siemens Aktiengesellschaft, Berlin & Munich, Fed. Rep. of Germany

[21] Appl. No.: 25,617

[22] Filed: Mar. 30, 1979

[30] Foreign Application Priority Data

May 24, 1978 [DE] Fed. Rep. of Germany ..... 2822811

[51] Int. Cl.[2] ..... H05G 1/42

[52] U.S. Cl. ..... 250/414; 250/409

[58] Field of Search ..... 250/403, 401, 414, 409

[56] References Cited

U.S. PATENT DOCUMENTS

| | | | |
|---|---|---|---|
| 2,240,478 | 5/1941 | Bischoff et al. | 250/403 |
| 4,032,788 | 6/1977 | Stege et al. | 250/414 |

FOREIGN PATENT DOCUMENTS 2122138 11/1972 Fed. Rep. of Germany .

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In an exemplary embodiment, a comparator is present which compares the actual value of the x-ray tube output with a time-varying rated value output of the function generator which controls the falling load characteristic, and effects the switching off of the x-ray tube to prevent an overloading thereof if the difference between the actual and the rated value of the x-ray tube output exceeds a predetermined limit for a time interval exceeding a predetermined minimum time span.

2 Claims, 2 Drawing Figures

X-RAY DIAGNOSTIC GENERATOR FOR OPERATION WITH FALLING LOAD

BACKGROUND OF THE INVENTION

The invention relates to an x-ray diagnostic generator for operation with falling load with a function generator which, during an x-ray exposure, generates a rated signal value for the x-ray tube output proceeding according to a falling exponential function, which effects the adjustment of the x-ray tube output via control means.

As a function generator, it is known to employ a capacitor which is charged before the beginning of an exposure to a value which corresponds to the peak value of the x-ray tube output and is discharged via a discharging resistor during an exposure corresponding to the temporal course of the highest allowable x-ray tube output (German OS No. 2,122,138). Thereby, the capacitor represents the rated value generator in a control loop for the x-ray tube output. The actual value of the x-ray tube output is thereby independent of disturbances, for example network voltage fluctuations.

In an x-ray diagnostic generator of this type, it is possible that, for instance because of a faulty working of the control means or of the controlled-gain amplifier, an overload of the x-ray tube ensues because the actual value of the x-ray tube output remains constant during an exposure despite the exponential drop of the rated value signal.

SUMMARY OF THE INVENTION

The object of the invention is to design an x-ray diagnostic generator of the type initially cited in such manner that, upon errors in the operation of the control circuit which is to lower the x-ray tube output during an exposure, i.e., when the x-ray tube voltage is not lowered in correspondence with the designed course during an exposure, an overload of the x-ray tube is prevented.

This object is inventively achieved by means of a comparator for the actual and the rated value of the x-ray tube output which is connected to a cut-off element for the x-ray tube and effects cut-off of x-ray tube operation when the difference between the actual and the rated value exceeds a predetermined limit. In the inventive x-ray diagnostic generator, the comparator monitors the difference between actual and rated value of the x-ray tube output. Upon errors in the circuit adjusting the x-ray tube output, the x-ray tube is switched off, and thus, an overload is prevented. A particularly expedient further development of the invention resides in the provision of a time function element which lies between the comparator and the cut-off element, which time function element relays a cut-off signal of the comparator to the cut-off element only when the cut-off signal is present at the input of the time function element during a programmed minimum tube span. Thereby, short-term disturbances and interference pulse spikes are blanked out.

In the following, the invention is explained in greater detail on the basis of a sample embodiment illustrated in the drawing; and other objects, features and advantages will be apparent from this detailed disclosure and from the appended claims.

DETAILED DESCRIPTION

Figure 1:
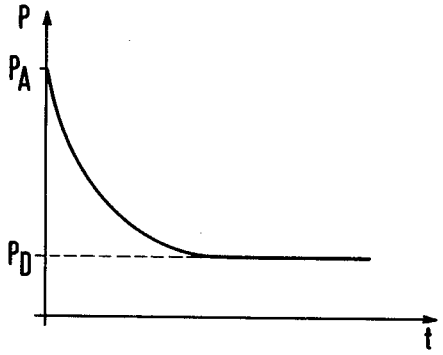
FIG. 1 shows an illustration of the course of the highest allowable x-ray tube output upon operation with falling load.

It proceeds from FIG. 1 that the highest allowable x-ray tube output P decreases exponentially from an initial value $P_A$ down to a constant value $P_D$. When the x-ray tube output is lowered during the production of an exposure in correspondence with the curve illustrated in FIG. 1, then the x-ray tube is always operated with its highest allowable output, i.e., the anode temperature is practically constant and has the highest allowable value and, upon termination of an exposure by means of an automatic exposure control, the shortest possible exposure time is thereby attained.

Figure 2:
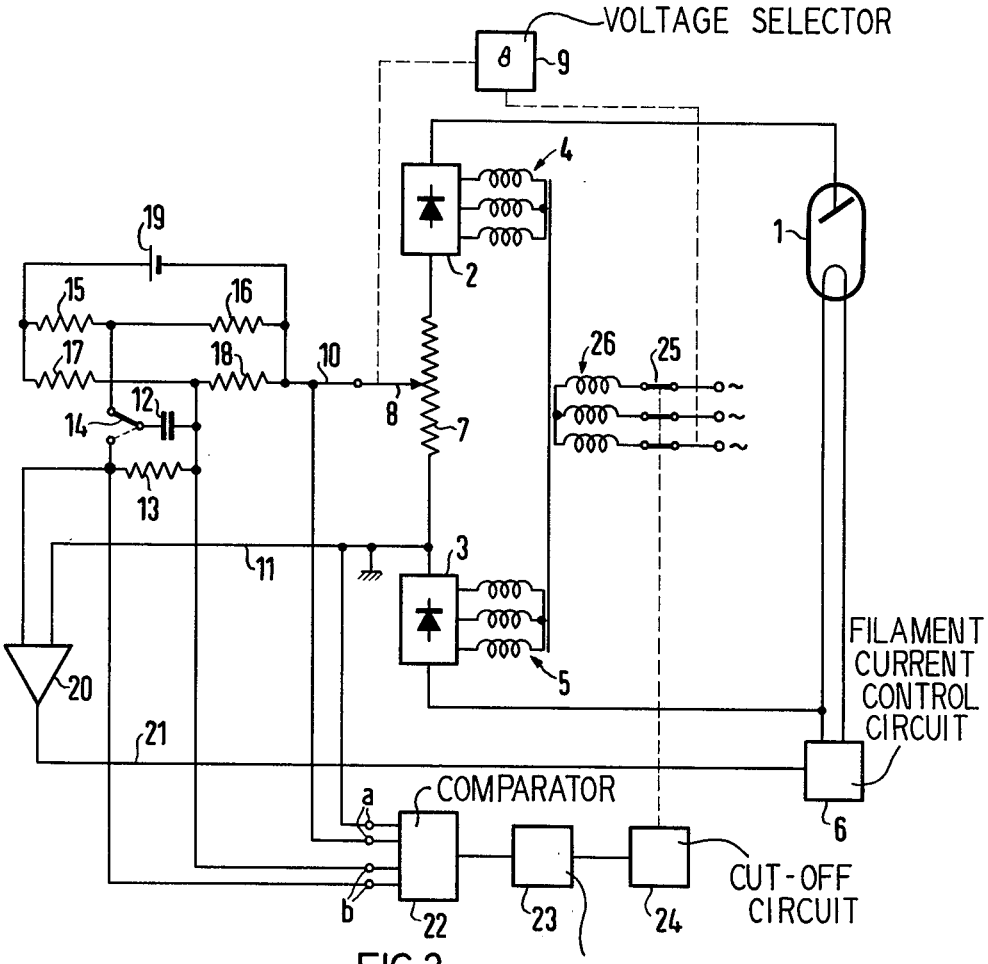
FIG. 2 is a circuit diagram showing an x-ray diagnostic generator according to the invention.

In the x-ray diagnostic generator illustrated in FIG. 2, the lowering of the x-ray tube output ensues in exact correspondence with the optimum course according to FIG. 1. The x-ray diagnostic generator, which supplies and controls an x-ray tube 1 and of which only the parts essential to the invention are illustrated, contains two high voltage rectifiers 2 and 3 which lie in series with one another and are supplied by the secondary windings 4 and 5 of a three-phase high voltage transformer. The x-ray tube current, which is adjustable via the filament current of the x-ray tube 1 via control means 6, traverses a voltage divider resistor 7 at which a voltage proportional to the x-ray tube current is tapped by means of a tap 8. A manually adjustable voltage selector 9 serves for the adjustment of the high voltage at the x-ray tube 1, which voltage selector influences a regulating transformer preconnected to the primary 26 of the high voltage transformer and also shifts the tap 8 corresponding to the respectively selected x-ray tube voltage. Because the x-ray tube voltage is held constant by means of known means not illustrated, a voltage lies between the line 10 and 11 which is proportional to the product of the x-ray tube voltage and the x-ray tube current, i.e., is proportional to the respective actual value of the x-ray tube output.

The actual value generator 7, 8 for the x-ray tube output is a component part of a control loop which contains a rated value generator which consists of a capacitor 12 and a discharging resistor 13 for the capacitor 12. Before the beginning of an exposure, the capacitor 12 is chargeable, with switch 14 in its illustrated upper position by means of a voltage tapped at two voltage dividers 15, 16 and 17, 18. During the production of an exposure, the switch 14 assumes its lower position indicated by a broken line and the capacitor 12 discharges itself via the discharging resistor 13. The voltage dividers 15, 16 and 17, 18 which are fed by a constant voltage source 19 are dimensioned in such manner that the voltage at capacitor 12 corresponds to the difference between the initial output $P_A$ and the constant output $P_D$ (FIG. 1) when the capacitor 12 is fully charged. The discharging resistor 13 is dimensioned in such manner that the voltage at capacitor 12 decreases during the discharge corresponding to the temporal course of the highest allowable x-ray tube output according to FIG. 1.

A voltage is present at the input of an amplifier 20 which corresponds to the difference between the voltage tapped at the discharging resistor 13 and at the voltage divider resistor 7, i.e., corresponds to the respective deviation of the actual value of the x-ray tube output from its rated value. Via line 21, the amplifier 20 influences the control means 6 for the x-ray tube current and thus for the x-ray tube output in such manner that the actual value of the x-ray tube output is readjusted to the rated value respectively prescribed by the voltage at the discharging resistor 13.

In the x-ray diagnostic generator illustrated in FIG. 2, the x-ray tube output during the production of an exposure proceeds exactly in correspondence with FIG. 1, i.e., it decreases exponentially from the highest allowable initial value $P_A$ to the constant value $P_D$ and has its highest allowable value at each point in time. With the termination of the exposure by means of an automatic exposure control, thus, the shortest possible exposure time is always attained. Disturbances, particularly network voltage fluctuations, are automatically leveled and practically do not influence the lowering of the x-ray tube output during the production of an exposure.

The divisor ratio of the voltage dividers 15, 16 and 17, 18 is determined once for a specific x-ray tube and then needs not be changed again upon operation of the x-ray diagnostic generator with this x-ray tube.

In the x-ray diagnostic generator according to FIG. 2, it can occur that the controlled-gain amplifier 20 or the control means 6 are defective. In order to prevent an overload of the x-ray tube in this case, a comparator 22 is present to which a signal corresponding to the actual value of the x-ray tube output is applied at its inputs a and a signal corresponding to the rated value of the x-ray tube output is supplied at its inputs b. The comparator has a predetermined threshold for the difference between this actual and rate value. When this difference thus exceeds a predetermined value, the comparator 22 delivers a signal to a time function element 23. The time function element 23 relays this signal when it pends at the input of the time function element 23 during a programmed minimum time span of, for example, 50 ms. In this case, a cut-off element 24 is activated which actuates the switches 25 which disconnects the primary windings 26 of the high voltage transformer 4, 5, 26 from the network and, thus, also switches the x-ray tube 1 off.

The comparator 22 can, for example, be programmed in such manner that it supplies a signal to the time function element 23 for shutting off the x-ray tube when the difference between the actual and the rated value of the x-ray tube output exceeds 2kW. Of course, this switching off only ensues when this transgression is present during the programmed minimum time of, for example, 50 ms in the time function element 23.

By way of example, the time function element 23 may be a timing circuit which requires the presence of the cutoff signal from comparator 22 substantially continuously for the duration of its timing cycle. For example if the timing circuit involves the timing of the discharge of a capacitance to a low voltage value which is reached only after discharge of the capacitor for fifty milliseconds, the discharge circuit may be controlled by a transistor which also shunts the charging source and thus prevents recharging the capacitance only so long as the cut-off signal holds the transistor in the conductive mode. Thus the capacitor is recharged at a predetermined relatively rapid rate if the cut-off signal is interrupted prior to the fifty-millisecond required duration, thereby resetting the timing circuit to its initial condition provided the cut-off signal is interrupted for a sufficient interval to be consistent with safe continued operation of the x-ray tube. When the timing capacitor is discharged to a predetermined low voltage value, an output transistor circuit may be triggered which holds contacts 25 open until manually reset.

It will be apparent that many modifications and variations may be effected without departing from the scope of the novel concepts and teachings of the present invention.

I claim as my invention:

1. An x-ray diagnostic generator for operation with falling load with a control means for controlling x-ray tube output, and a function generator which, during an x-ray exposure, generates a rated value signal for the x-ray tube output according to a falling exponential function which effects the adjustment of the x-ray tube output via the control means, characterized by a cut-off element (24) actuatable for shutting off x-ray tube operation prior to expiration of the x-ray exposure time, and a comparator (22) for comparing the actual and the rated value of the x-ray tube output, and connected to the cut-off element (24) for actuating the same to switch off x-ray tube operation when the difference between actual and rated value exceeds a predetermined value.

2. An x-ray diagnostic generator according to claim 1, characterized in that a time function element (23) lies between the comparator (22) and the cut-off element (24), which time function element (23) only relays a cut-off signal of the comparator (22) to the cut-off element (24) when the cut-off signal is present at the input of the time function element (23) during a programmed minimum time span.

* * * * *